US011393646B2

(12) United States Patent
Iniguez et al.

(10) Patent No.: US 11,393,646 B2
(45) Date of Patent: Jul. 19, 2022

(54) HAND HELD ROTARY POWER TOOL

(71) Applicant: Robert Bosch GmbH, Stuttgart (DE)

(72) Inventors: Fernando Porchas Iniguez, Arlington Heights, IL (US); Melchor Israel Chairez Lizcano, Baja California (MX); Jaime Moreno Terrazas, Imperial, CA (US); Alejandra Sanchez Hijar, Guadalajara (MX)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/115,899

(22) Filed: Dec. 9, 2020

(65) Prior Publication Data

US 2022/0181104 A1 Jun. 9, 2022

(51) Int. Cl.
*H01H 23/14* (2006.01)
*H01H 9/06* (2006.01)

(52) U.S. Cl.
CPC ..... *H01H 23/141* (2013.01); *H01H 9/06* (2013.01); *H01H 23/143* (2013.01)

(58) Field of Classification Search
CPC ..... H01H 23/141; H01H 23/143; H01H 9/06; H01H 25/00; H01H 15/00; H01H 15/02; H01H 2221/004
See application file for complete search history.

(56) References Cited

U.S. PATENT DOCUMENTS

| | | | | |
|---|---|---|---|---|
| 3,174,002 | A | 3/1965 | Golbeck | |
| 3,766,352 | A | 10/1973 | Bigley et al. | |
| 4,280,026 | A * | 7/1981 | Alessio | H01H 3/20 200/321 |
| 4,816,626 | A | 3/1989 | Valenzona et al. | |
| 6,380,502 | B1 | 4/2002 | Hirschburger et al. | |
| 7,942,617 | B2 | 5/2011 | Allemann et al. | |
| 10,326,399 | B2 | 6/2019 | Hirschburger | |
| 10,478,961 | B2 * | 11/2019 | Barth | H01H 3/20 |
| 10,500,707 | B2 | 12/2019 | Hirschburger | |
| 10,796,859 | B2 * | 10/2020 | Lutz | B24B 23/028 |

FOREIGN PATENT DOCUMENTS

DE 3902964 7/1990

* cited by examiner

*Primary Examiner* — Lheiren Mae A Caroc
(74) *Attorney, Agent, or Firm* — Kelly McGlashen

(57) ABSTRACT

A power tool includes a motor and a power supply that are connected by a switch disposed in an electrical circuit. The switch controls the on/off state of the motor and is actuated by a switch actuator that serves as a spring element. The switch actuator includes a guide plate supported on the housing, and a resilient arm that protrudes from the guide plate into an opening in the tool housing. When the switch actuator is in a first actuator position relative to the housing, the resilient arm is biased toward an edge of the opening and engages the edge, thereby preventing inadvertent movement of the switch actuator to the second actuator position. When the switch actuator is actuated by applying a bi-directional manual force to the resilient arm, the resilient arm is displaced from the edge, thereby permitting movement of the switch actuator to the second actuator position.

12 Claims, 14 Drawing Sheets

HAND HELD ROTARY POWER TOOL

BACKGROUND

Hand-held rotary power tools may include a motor having an output shaft to which tools and/or accessories may be attached. For example, a wide range of accessories may be interchangeably connected to the output shaft, including bits, grinding wheels, buffing pads, scrubbing pads, etc. The motor is powered by a power supply, and operation of the motor is controlled by an on/off switch disposed in an electrical circuit that connects the motor to the power supply.

Some small hand held rotary power tools have an on/off switch of the type that employs a sliding activation motion. In some circumstances, sliding on/off switches may be inadvertently actuated. For example, such an inadvertent actuation can occur as a result of the tool being accidentally dropped in such a way that the switch is impacted. In this situation, the power tool may be turned on while not being held by an operator. Moreover, if a shaping accessory such as a bit, grinding wheel, scrubbing pad, etc. is attached to the output shaft, the power tool may damage the environment if the power tool is turned on while not being held by an operator. For at least this reason, it is desirable to prevent inadvertent actuation of the on/off switch.

SUMMARY

In some aspects, a power tool includes a tool housing. The tool housing includes a wall portion, and the wall portion includes a switch opening that is defined by a wall edge that extends between an outer surface of the wall and an inner surface of the wall. The power tool includes a motor disposed in the tool housing, and a power supply that is connected to the motor via an electrical circuit. The electrical circuit is disposed in the tool housing. The power tool includes an electrical switch disposed in the electrical circuit. The electrical switch includes a switch body and a contact element that protrudes from the switch body. The contact element is movable relative to the switch body between a first switch position in which the electrical circuit is open and current is prevented from flowing from the power supply to the motor, and a second switch position in which the electrical circuit is closed and current flows from the power supply to the motor. The power tool also includes a switch actuator that is disposed in tool housing so as to be accessible to an operator of the tool via the switch opening. The switch actuator includes a guide plate that is disposed in the tool housing, and a resilient arm that extends from, and is integrally formed with, the guide plate. The switch actuator is moveable relative to the tool housing between a first actuator position and a second actuator position. When the switch actuator is in the first actuator position, the guide plate is disposed inward relative to an inner surface of the wall portion, a first edge portion of the guide plate is positioned at a first guide plate position relative to the tool housing, the resilient arm is offset relative to the guide plate a first distance so as to protrude into the switch opening, and a portion of an edge of the resilient arm is engaged with the wall edge. When the switch actuator is in the second actuator position, the guide plate is disposed inward relative to the inner surface of the wall portion, the first edge portion of the guide plate is positioned at a second guide plate position relative to the tool housing, the second guide plate position is longitudinally spaced apart from the first guide plate position, the resilient arm is offset relative to the guide plate a second distance, and the second distance is less than the first distance whereby the portion of an edge of the resilient arm is disengaged from the wall edge and is disposed inward relative to the inner surface of the wall portion. In addition, the switch actuator cooperates with the contact element in such a way that when the switch actuator is in the first actuator position, the contact element is in the first switch position, and when the switch actuator is in the second actuator position, the contact element is in second switch position.

In some embodiments, the switch actuator is actuated by applying a bi-directional manual force to the resilient arm.

In some embodiments, movement of the switch actuator between the first actuator position and the second actuator position requires a first movement in a first direction followed by a second movement in a second direction, and the second direction is perpendicular to the first direction.

In some embodiments, the guide plate comprises a central opening that is defined by an inner edge, and the resilient arm protrudes from the inner edge.

In some embodiments, the resilient arm includes a lever portion and a ramp portion that connects the lever portion to the inner edge, and the ramp portion is angled relative to an outward facing surface of the guide plate whereby the lever portion is offset relative to the guide plate.

In some embodiments, the switch actuator is a spring.

In some embodiments, the guide plate includes a toggle opening. In addition, when the switch actuator is in the first actuator position, a portion of the contact element extends into the offset opening whereby the electrical switch is positioned in the first switch position, and when the switch actuator is in the second actuator position, the portion of the contact element abuts an inward facing surface of the guide plate, whereby the electrical switch is positioned in the second switch position.

In some embodiments, when the switch actuator is in the first actuator position, the resilient arm is biased toward the wall edge such that the portion of an edge of the resilient arm engages the wall edge, thereby preventing movement of the switch actuator to the second actuator position. In addition, when the switch actuator is in the second actuator position, the portion of an edge of the resilient arm is displaced from the wall edge, thereby permitting movement of the switch actuator to the second actuator position.

In some embodiments, the tool housing includes a shelf that protrudes from the wall portion and at least partially underlies the switch opening, and the switch actuator is supported on, and is slideable relative to, the shelf.

In some embodiments, the shelf includes an opening, and the contact element protrudes through the opening.

In some embodiments, the tool housing includes a pair of locating ribs that protrude from the wall portion toward the switch actuator, the locating ribs extending in a direction that is perpendicular a movement direction of the switch actuator. The guide plate includes a second edge portion and a tab that protrudes from the second edge portion. When the switch actuator is in the first actuator position, the tab abuts a first rib of the pair of locating ribs, and the first rib of the pair of locating ribs is disposed between the tab and the second rib of the pair of locating ribs. In addition, when the switch actuator is in the second actuator position, the tab is disposed between the first rib of the pair of locating ribs and a second rib of the pair of locating ribs.

In some embodiments, the resilient arm comprises an outward-facing surface, and a platform that protrudes from the outward-facing surface. The platform is shaped and dimensioned to be received within the switch opening regardless of switch actuator position, and the platform includes surface features that enhance gripping of the platform by a user of the power tool.

A hand-held rotary power tool includes a motor and a power supply that are connected by a switch disposed in an electrical circuit. The switch controls the on/off state of the motor and is actuated by a switch actuator that serves as a spring element. The switch actuator includes a guide plate supported on the housing, and a resilient arm that protrudes from the guide plate into an opening in the tool housing. When the switch actuator is in a first actuator position relative to the housing, the resilient arm is biased toward an edge of the opening and engages the edge, thereby preventing inadvertent movement of the switch actuator to the second actuator position. When the switch actuator is actuated by applying a bi-directional manual force to the resilient arm, the resilient arm is displaced from the edge, thereby permitting movement of the switch actuator to the second actuator position.

The switch actuator is made out of molded plastic, and is designed to act as a spring. The switch actuator requires two movements from the user to be moved relative to the tool housing and actuate the switch that controls the on/off state of the motor. The first movement is inward, achieved by the user applying a radially directed force to the switch actuator, achieved by pressing the actuator switch inward using a tip of a finger. This movement detaches the actuator switch from engagement with the tool housing. The second movement is longitudinal, achieved by the user applying a longitudinally directed force to the switch actuator, achieved by moving the actuator longitudinally using a tip of a finger. The second movement can only be performed after the first movement. Although an impact load applied to the switch actuator, caused for example by dropping the power tool onto the switch actuator, may inadvertently achieve the first movement, it is unlikely that the subsequent second movement would result during the impact, whereby the switch actuator would prevent an inadvertent change in operating state of the power tool.

DETAILED DESCRIPTION

Figure 1:
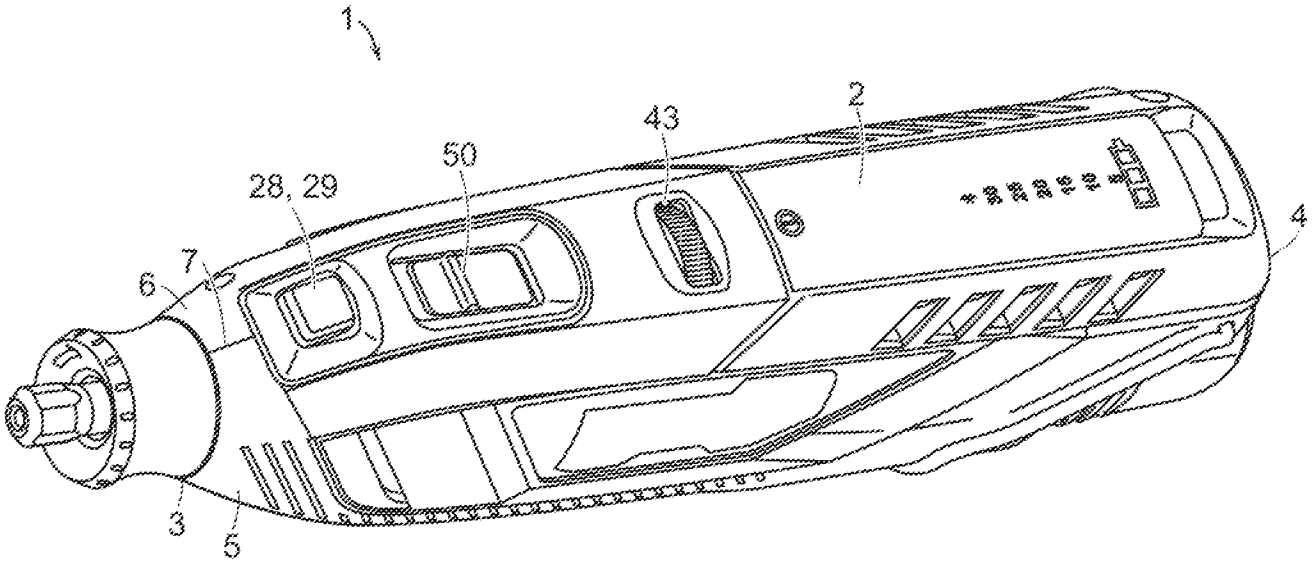
FIG. 1 is a top perspective view of the hand-held rotary power tool including a switch actuator.
Figure 2:
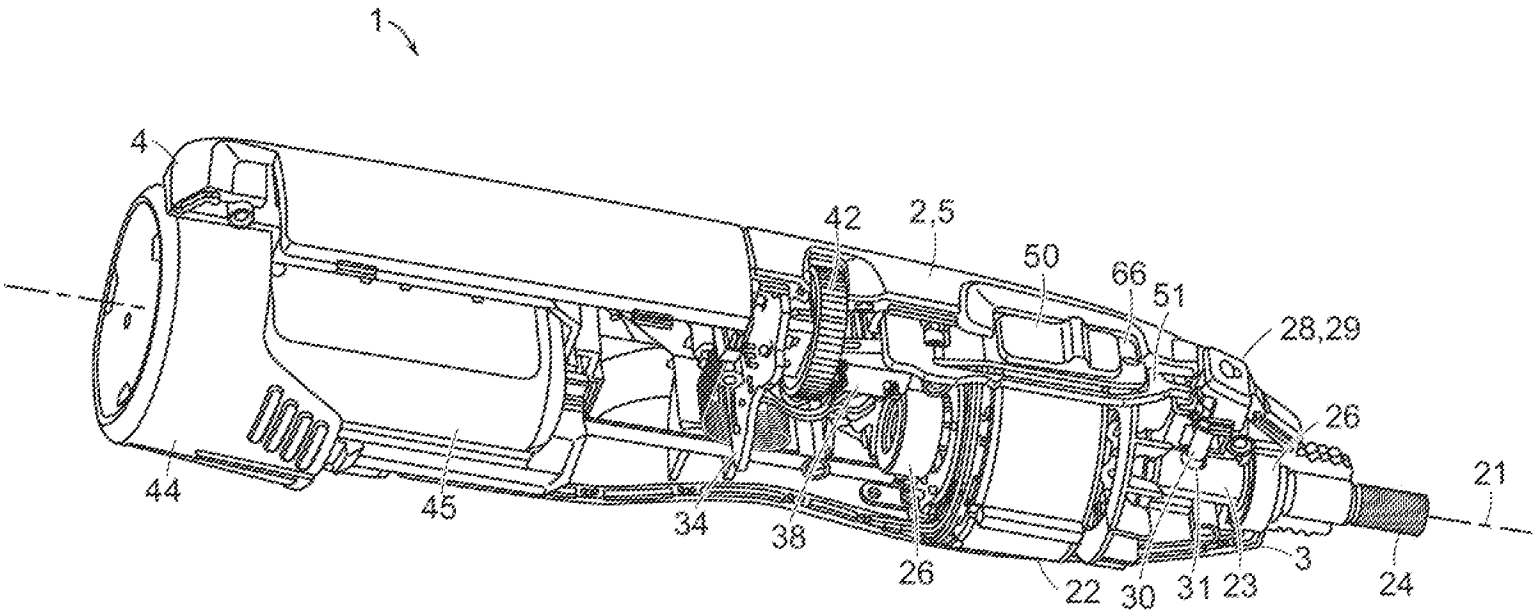
FIG. 2 is a perspective view of the power tool of FIG. 1, illustrated with a portion of the tool housing removed to permit visualization of the internal components of the power tool.
Figure 3:
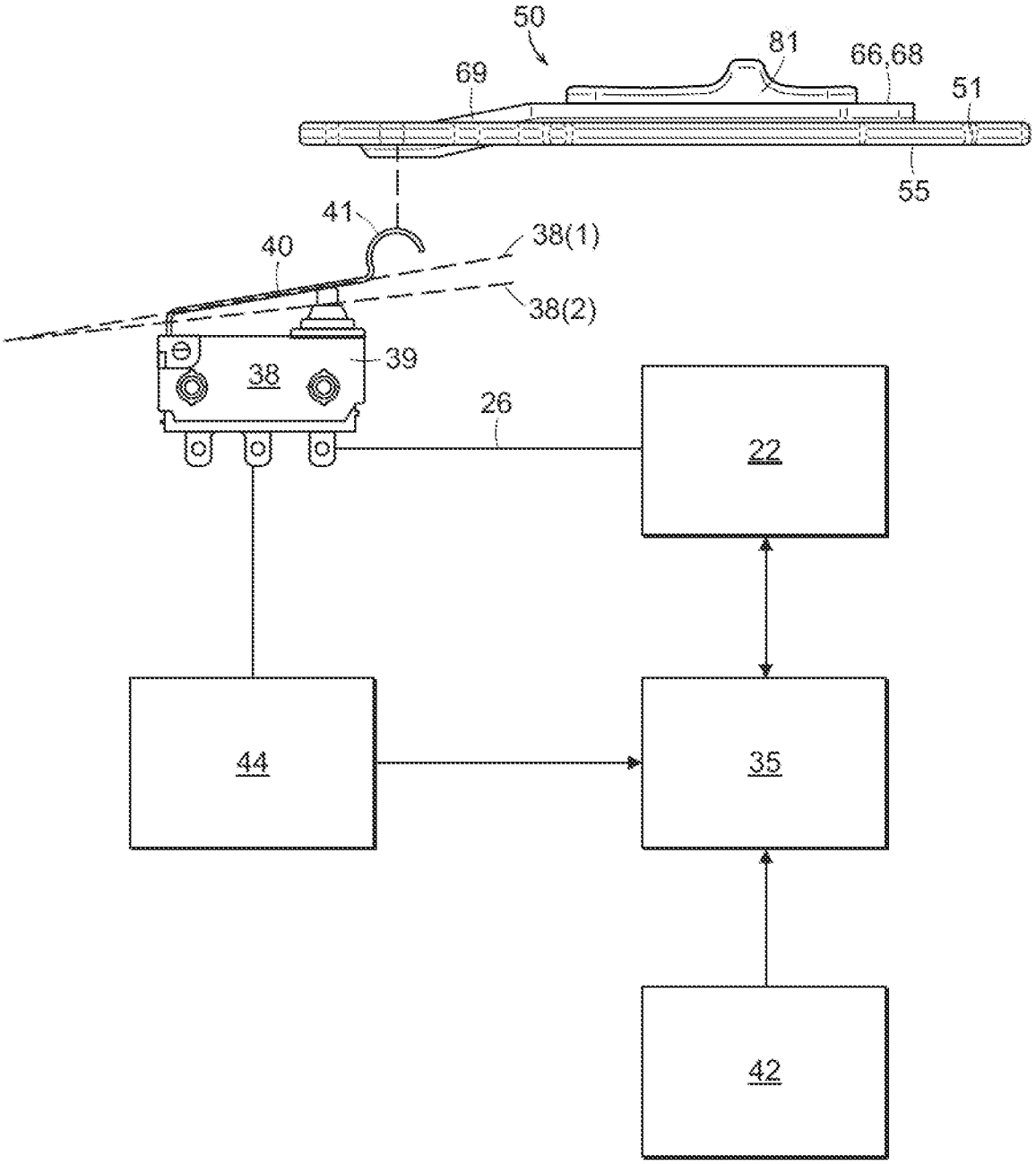
FIG. 3 is a schematic diagram illustrating the electrical circuit provided in the power tool of FIG. 1.

Referring to FIGS. 1-3, a hand-held rotary power tool 1 includes an electric motor 22 disposed in a tool housing 2. The tool housing 2 has a generally cylindrical shape that is ergonomically contoured to be grasped in the hand of a user, whereby the tool housing 2 serves as a handle of the power tool 1. An output shaft 23 of the electric motor 22 extends in parallel to a longitudinal axis 21 of the tool housing 2, and is connected in a gearless fashion to a threaded tool spindle 24. The tool spindle 24 protrudes outward from a first end 3 of the tool housing 2, and is configured to provide a mechanical connection to various accessories (not shown) for the purpose of processing a workpiece. The accessories may include, but are not limited to, an engraving cutter, a milling cutter, a grinding disk, a grindstone, a polishing tip, a polishing disk, a polishing brush, a cutter disk, a saw blade and a drill. The electric motor 22 is powered by a power supply 44 that is detachably connected to a second end 4 of the tool housing 2. The power supply 44 is connected to the electric motor 22 via an electric circuit 26 that is disposed in the tool housing 2. The power tool 1 includes an electrical switch 38 that is disposed in the electrical circuit and controls the on-off state of the electric motor 22. The electrical switch 38 is entirely disposed within the tool housing 2, and is actuated by an operator of the power tool 1 via a switch actuator 50. The switch actuator 50 is disposed in tool housing 2 so as to be accessible to an operator of the power tool 1 via a switch opening 16 provided in the tool housing 2. The switch actuator 50 cooperates with the electrical switch 38 in such a way that movement of the switch actuator 50 relative to the tool housing 2 results in a change in the on-off state of the electrical switch 38. Thus, the switch actuator 50 is used by the operator of the power tool 1 to control the on-off state of the power tool 1. The switch actuator 50 includes a guide plate 51 that is disposed in the tool housing 2, and a resilient arm 66 that extends from, and is integrally formed with, the guide plate 51. The resilient an 66 protrudes into the switch opening 16 so as to be accessible to the operator of the power tool 1. The switch actuator 50 is configured to prevent inadvertent actuation of the electrical switch 38, as will be described in detail below.

In the illustrated embodiment, the power supply 44 includes a rechargeable battery pack 45 that is detachably connected to the tool housing second end 4. In other embodiments, the power supply 44 may consist of primary batteries that are housed within the tool housing 2. In still other embodiments, the power supply 44 may be remote from the tool housing 2, and connected to the tool housing 2 via a cord (not shown) that encloses an electrically conductive wire.

The electrical switch 38 includes a switch body 39 and a contact element 40 that protrudes from the switch body 39. In the illustrated embodiment, the contact element 40 is an elongated lever arm that is used to toggle the electrical switch 38 between first and second positions via a change in angle of the contact element 40 relative to the switch body 39. In particular, the contact element 40 is movable via the switch body 39 between a first switch position, represented in FIG. 3 by broken line 38(1), in which the electrical circuit is open and current is prevented from flowing from the power supply 44 to the motor 22, and a second switch position. In the second switch position, represented in FIG. 3 by broken line 38(2), the electrical circuit is closed and current flows from the power supply 44 to the motor 22. In the illustrated embodiment, the electrical switch 38 is supported within the tool housing 2 in an orientation in which the contact element 40 is movable in a plane that is parallel to the tool housing longitudinal axis 21.

When the electrical switch 38 is in the second switch position, the electric motor 22 drives the tool spindle 24 at a rotational speed higher than 10 000 min-1. In some embodiments, the rotational speed of the electric motor 22 can be adjusted by an operator between 10 000 min-1 and 40 000 min-1 via a rotary speed control knob 42.

The power tool 1 includes an output shaft lock mechanism 28 having a depressible control button 29 that caps a locking shaft 30. The locking shaft 30, when actuated by the control button 29, is configured to engage an opening 31 in the output shaft 23 to prevent rotation of the output shaft 23 while an accessory is being attached thereto. The output shaft lock mechanism 28 also includes a spring 33 that biases the locking shaft 30 and control button 29 toward a disengaged configuration.

The tool housing 2 encloses the motor 22, the electrical switch 38, the switch actuator 50, the output shaft lock mechanism 28, the speed control knob 42, output shaft support bearings 26, a printed circuit board 34 that supports a controller 35 and other ancillary components and structures. The controller 35, for example, may control a voltage supplied to the electric motor 22.

In the illustrated embodiment, the tool housing longitudinal axis 21 extends between the opposed tool housing first and second ends 3, 4, and is parallel to the motor output shaft 23. In addition, the tool housing 2 is elongated along the longitudinal axis 21. The tool housing 2 is a thin-walled structure that includes two wall portions, or "half shells," 5, 6 that fit together to enclose the other components of the power tool 1. The wall portions 5, 6 form left and right sides of the tool housing 2 that are joined along a seam 7 that extends longitudinally along the top and bottom of the power tool 1, where the terms "top" and "bottom" are used with respect to the orientation illustrated in FIG. 2, and are not intended to be limiting. The wall portions 5, 6 are generally mirror images of each other. In FIGS. 2 and 5-7 and 12-13, only the wall portion 5 is shown, while the other wall portion 6 is omitted to permit visualization of the components that are located inside of the housing and/or the structure of the interior of the housing.

Figure 4:
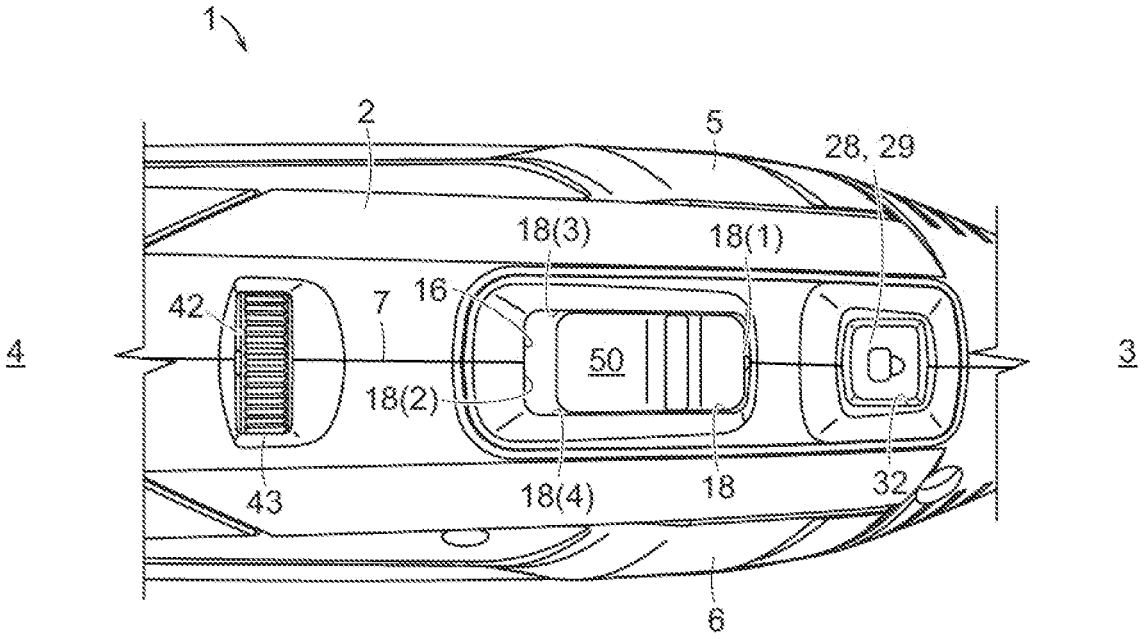
FIG. 4 is a top view of a portion of the power tool of FIG. 1.
Figure 5:
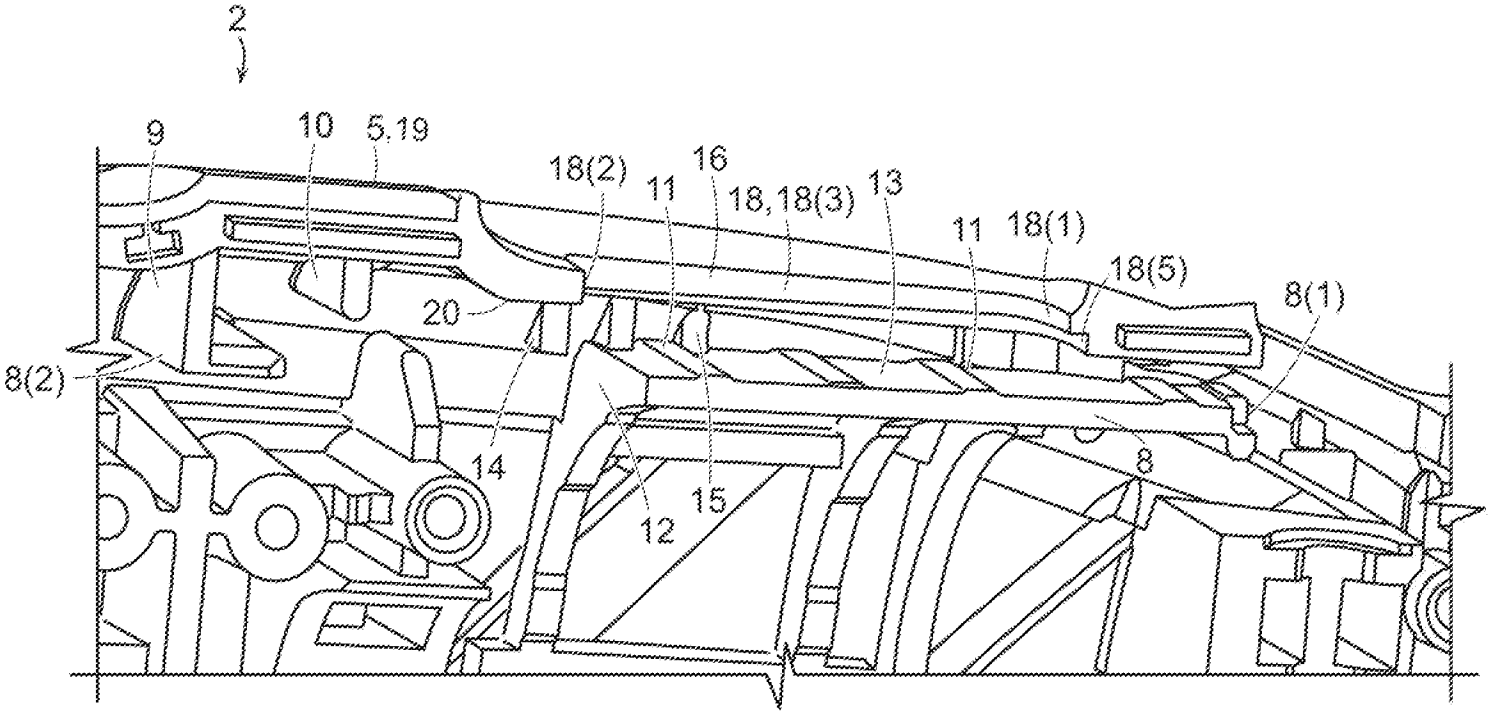
FIG. 5 is a side view of a portion of the tool housing of the power tool of FIG. 1.

Referring also to FIGS. 4-5, the tool housing 2 includes a switch opening 16 that receives the switch actuator 50 and is disposed on the top of the tool housing 2 at a location coinciding with the seam 7. The switch opening 16 is located between the tool housing first end 3 and a midpoint between the tool housing first and second ends 3, 4. The switch opening 16 is defined by a wall edge 18 that extends between an outer surface 19 of the tool housing 2 and an inner surface 20 of the tool housing 2. The switch opening 16 is rectangular in profile when the tool housing 2 is viewed facing the top, and is elongated in a direction parallel to the longitudinal axis 21. The wall edge 18 includes a first end portion 18(1) that extends perpendicular to the longitudinal axis 21, and a second end portion 18(2) that is opposed to the first end portion 18(1). The first end portion 18(1) is disposed between the second end portion 18(2) and the tool housing first end 3. In addition, the wall edge 18 includes a first side portion 18(3) that extends between the first and second end portions 18(1), 18(2) and is defined in the first wall portion 5, and a second side portion 18(4) that is parallel to the first side portion 18(3) and is defined in the second wall portion 6. The first end portion 18(1) of the wall edge 18 includes a recess 18(5) at the intersection between the wall edge 18 and the tool housing inner surface 20. The recess 18(5) provides an abutment surface that cooperates with a portion of the switch actuator 50 when the switch actuator 50 is in a first actuator position, as discussed in more detail below.

The tool housing 2 includes a knob opening 43 that receives the rotary speed control knob 42. The knob opening 43 is disposed on the top of the tool housing 2 at a location coinciding with the seam 7. The knob opening 43 is located between the tool housing second end 4 and the switch opening 16.

The tool housing 2 includes a control button opening 32 that receives the depressible control button 29 of the shaft lock mechanism 28. The control button opening 32 is disposed on the top of the tool housing 2 at a location coinciding with the seam 7. The control button opening 32 is located between the tool housing first end 3 and the switch opening 16.

The tool housing 2 includes a shelf 8 that protrudes from opposed portions of the wall portions 5, 6 in such a way that the shelf 8 is parallel to, and underlies, the switch opening 16. The shelf 8 is generally planar, and has a longitudinal dimension that is greater than the longitudinal dimension of the switch opening 16, whereby the shelf first end 8(1) is aligned with the control button opening 32, and the shelf second end 8(2), which is opposed to the shelf first end 8(1), is disposed between the switch opening 16 and the knob opening 43. A switch opening-facing surface 13 of the shelf 8 includes low profile, flat-topped ridges 11. The ridges 11 extend in a direction perpendicular to the longitudinal axis 21, and are spaced apart along the longitudinal axis 21. In use, the switch actuator 50 is supported on the ridges, and when the switch actuator 50 is actuated, the switch actuator 50 slides longitudinally along the shelf 8, whereby the ridges 11 serve to provide a reduced friction sliding surface and to wipe debris from the facing surface 55 of the switch actuator 50, which is collected in the space between adjacent ridges 11.

The shelf 8 includes an opening 12 that is shaped and dimensioned to allow the contact element 40 to pass therethrough. The opening 12 is longitudinally positioned closer to the shelf second end 8(2) than the shelf first end 8(1), whereby it is aligned with the second end portion 18(2) of the wall edge 18 that defines the switch opening 16.

The tool housing 2 includes a stop wall 9 and a leveling wall 10 that protrude inward and extend in a direction perpendicular to the shelf 8. The stop wall 2 is connected to the shelf second end 8(2), and limits the movement of the switch actuator 50 toward the tool housing second end 4. The leveling wall 10 is disposed between the stop wall 9 and the switch opening 16. The leveling wall 10 protrudes toward the shelf 8, but is spaced apart from the shelf 8. The gap between the leveling wall 10 and the shelf 8 is dimensioned to receive a portion of the switch actuator 50 with a clearance fit. By this configuration, the leveling wall 10 maintains the switch actuator 50 in a desired orientation relative to the tool housing 2, for example by preventing tilting of the switch actuator 50 relative to the shelf 8.

The tool housing 8 includes a pair of locating ribs 14, 15 that protrude from each of opposed portions of the wall portions 5, 6 toward the peripheral edge 56 of the switch actuator 50. To this end, the locating ribs 14, 15 are disposed adjacent to the switch opening-facing surface 13 of the shelf 8. The locating ribs 14, 15 are longitudinally spaced apart, and provide a corrugated structure that is configured to engage with a corresponding locating tab 64 that protrudes from the peripheral edge 56 of the switch actuator 50, as discussed in more detail below.

Figure 6:
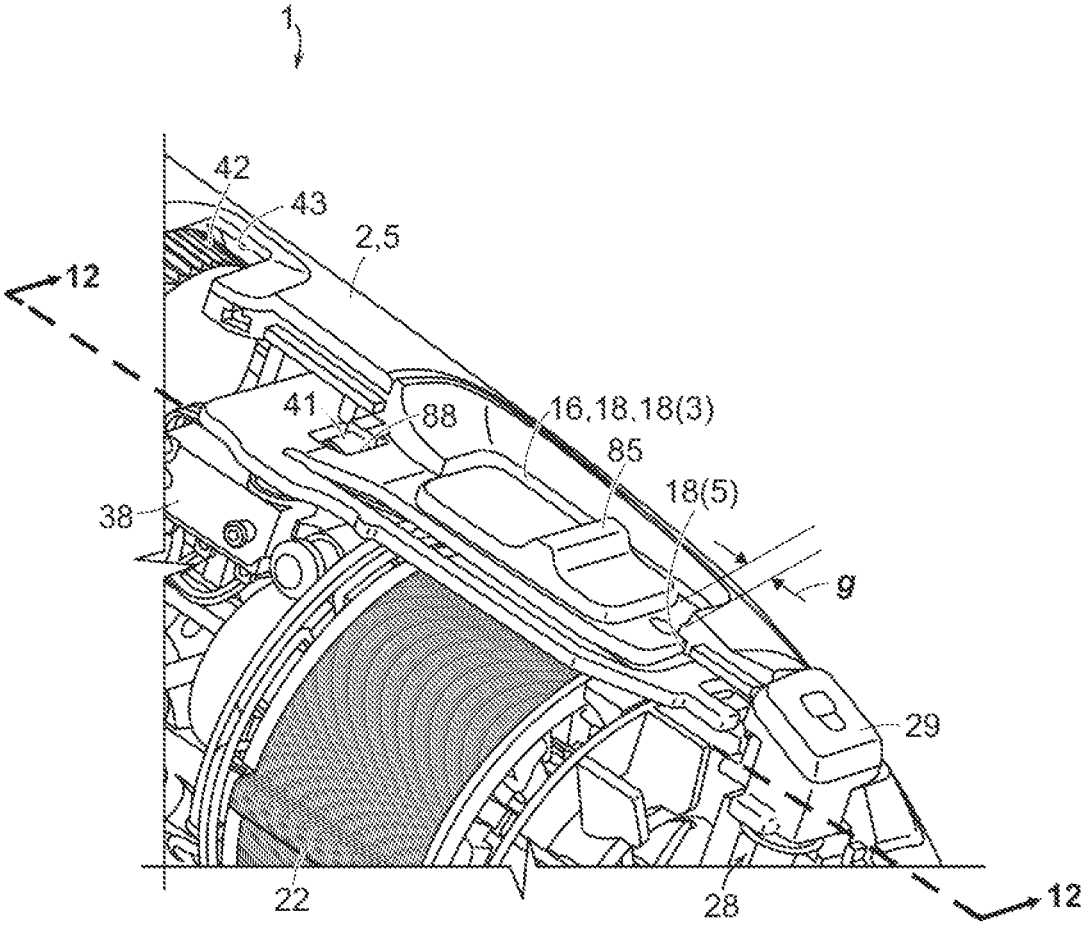
FIG. 6 is a perspective view of a portion of the power tool of FIG. 1, illustrated with a portion of the tool housing removed to permit visualization of the internal components of the power tool and showing the switch actuator in the first actuator position.
Figure 7:
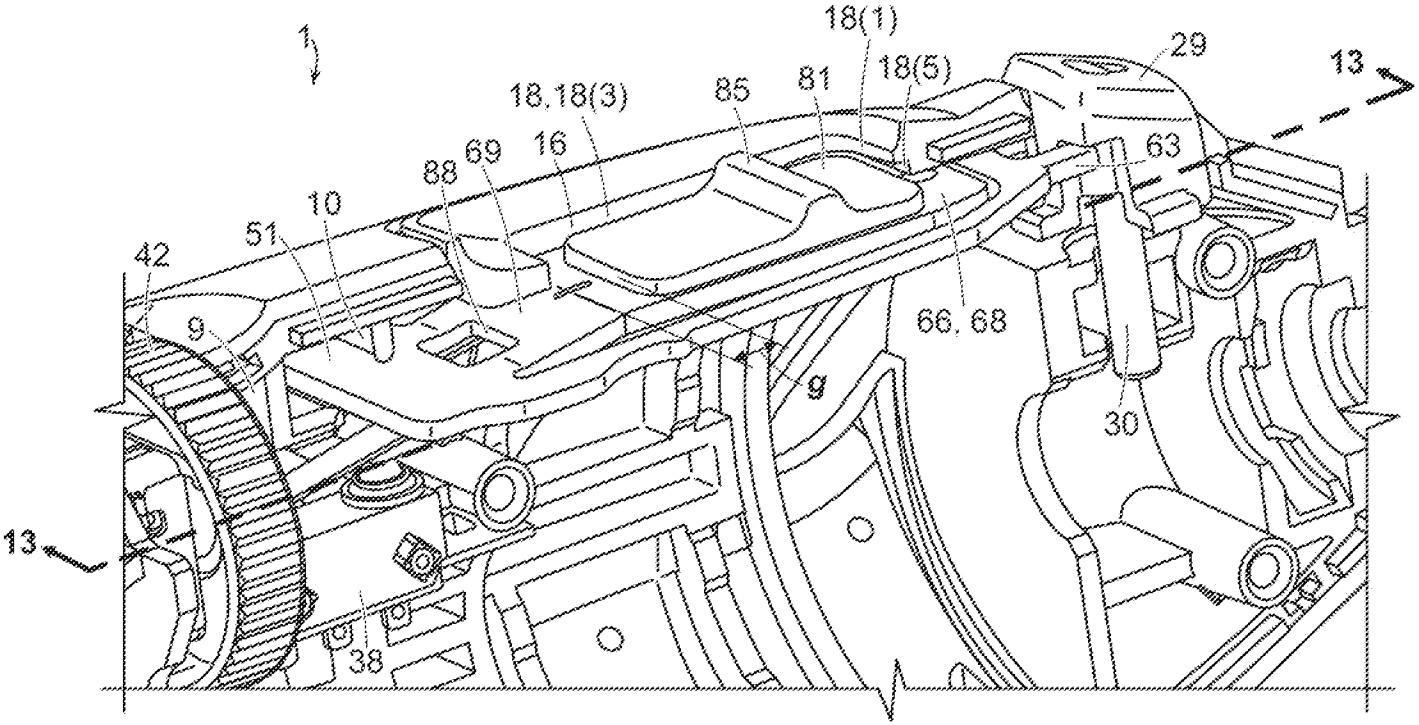
FIG. 7 is another perspective view of a portion of the power tool of FIG. 1, illustrated with a portion of the tool housing and some internal components removed to permit visualization of switch actuator and showing the switch actuator in the second actuator position.

Referring to FIGS. 6 and 7, the switch actuator 50 is disposed in tool housing 2 in such a way as to be supported on the shelf 8, and to partially protrude into the switch opening 16. The switch actuator 50 includes a planar guide plate 51 that rests on the shelf 8, and a resilient arm 66 that is integrally formed with the guide plate 51. A portion of the resilient arm 66 extends into the switch opening 16. The switch actuator 50 will now be described in detail.

Referring also to FIGS. 8-11, the guide plate 51 includes an outward-facing surface 54 (e.g., a switch opening-facing surface), an inward-facing, surface 55 (e.g., a motor-facing surface) that is opposed to the outward-facing surface 54, and a peripheral edge 56 that extends between the outward-facing surface 54 and the inward-facing surface 55. The peripheral edge 56 includes a front end portion 56(1) that faces the tool housing first end 3, and a rear end portion 56(2) that is opposed to the front end portion 56(1) and faces the tool housing second end 4. The peripheral edge 56 includes a first side portion 56(3) that extends between the front and rear end portions 56(1), 56(2) on one side of the guide plate 51, and a second side portion 56(4) that extends between the front and rear end portions 56(1), 56(2) on the opposed side of the guide plate 51.

The guide plate 51 includes a pair of guide rails 63 that protrude longitudinally from the front end portion 56(1) of the peripheral edge 56. The guide rails 63, 63 are spaced apart in a direction perpendicular to the longitudinal axis 21. In the second actuator position, discussed further below, the guide rails 63 protrude into shaft lock mechanism 28 in such a way that a guide rail 63 is disposed on each of opposed sides of the control button 29 (FIG. 7).

Figure 12:
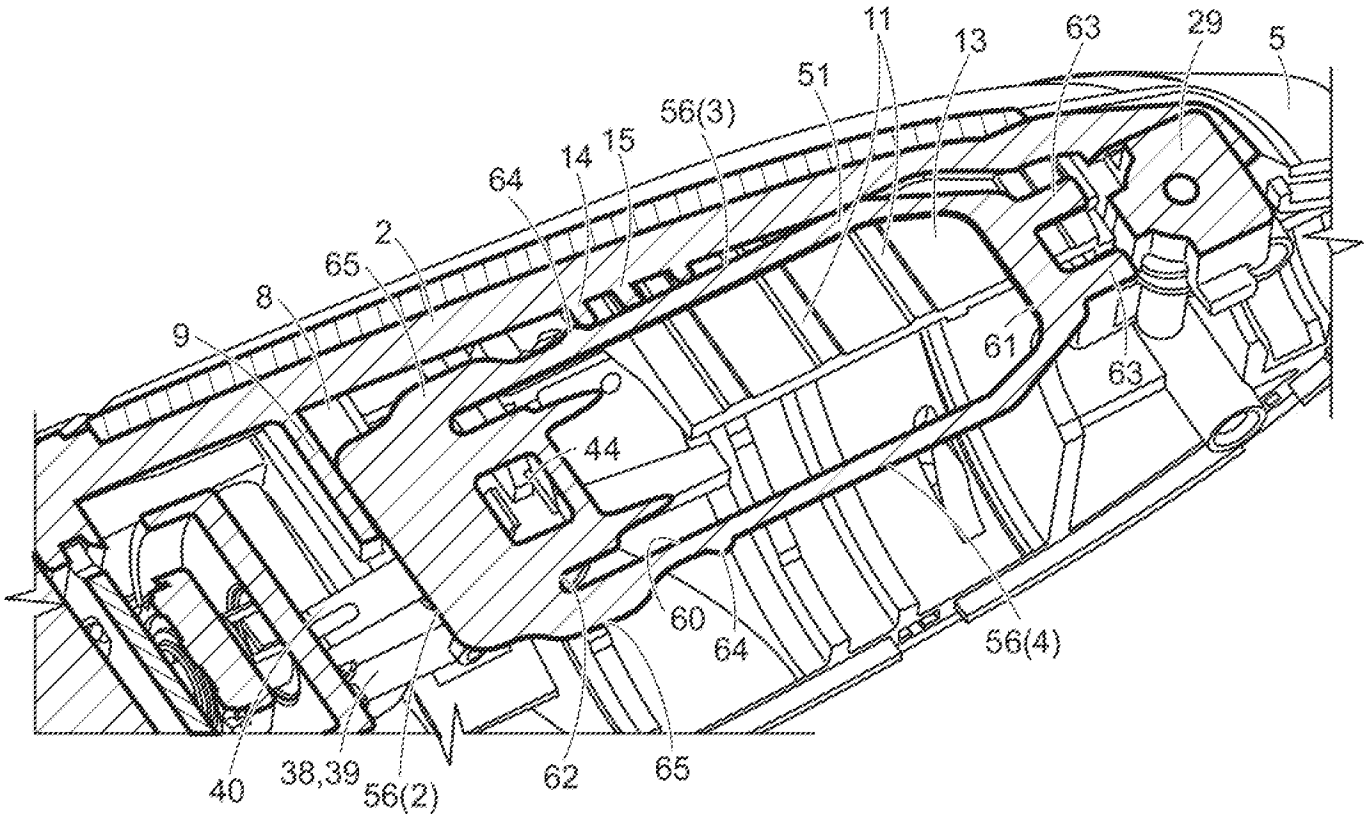
FIG. 12 is a cross sectional view of the power tool of FIG. 1, as seen along line 12-12 of FIG. 6, illustrated with a portion of the tool housing and some internal components removed to permit visualization of switch actuator in the first actuator position.
Figure 13:
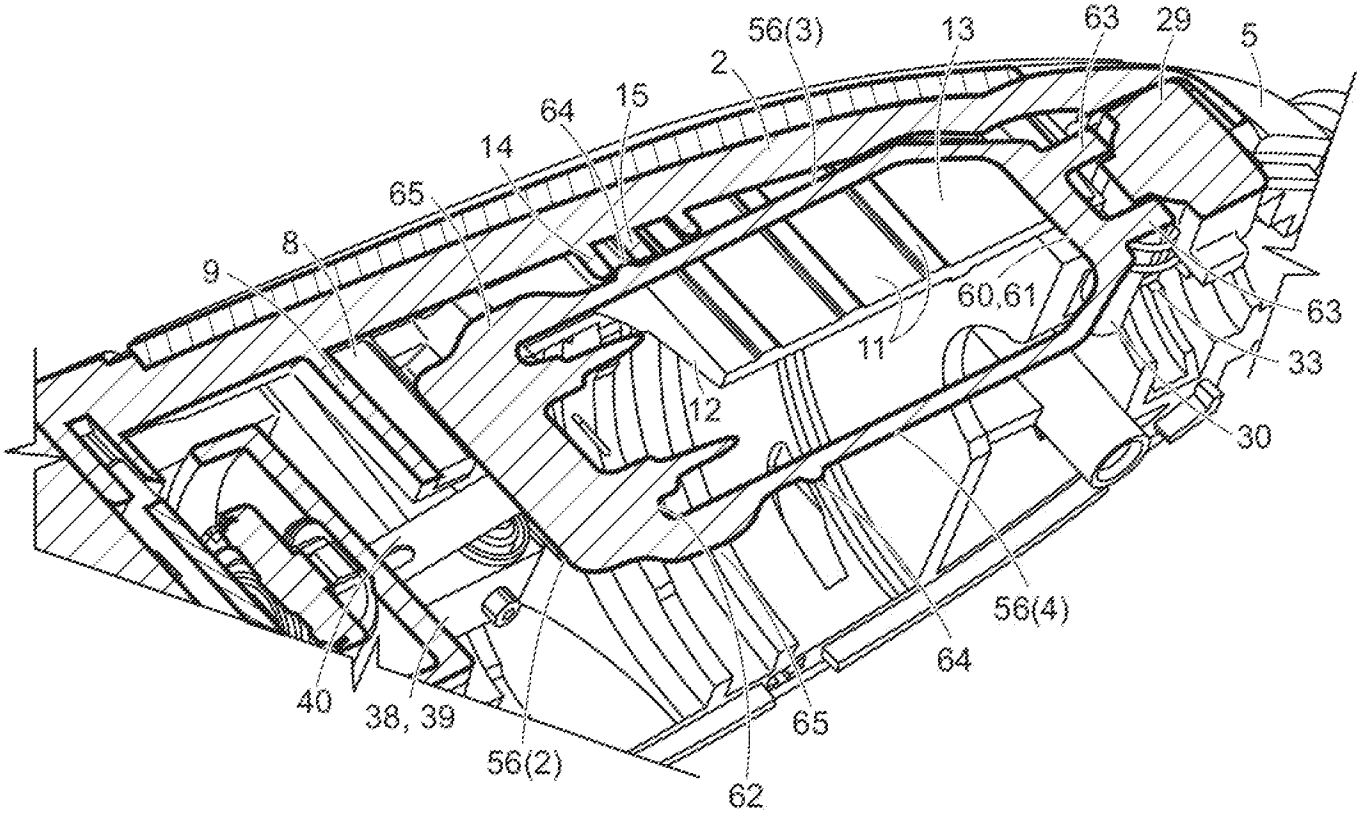
FIG. 13 is a cross sectional view of the power tool of FIG. 1, as seen along line 13-13 of FIG. 7, illustrated with a portion of the tool housing and some internal components removed to permit visualization of switch actuator in the second actuator position.
Figure 14:
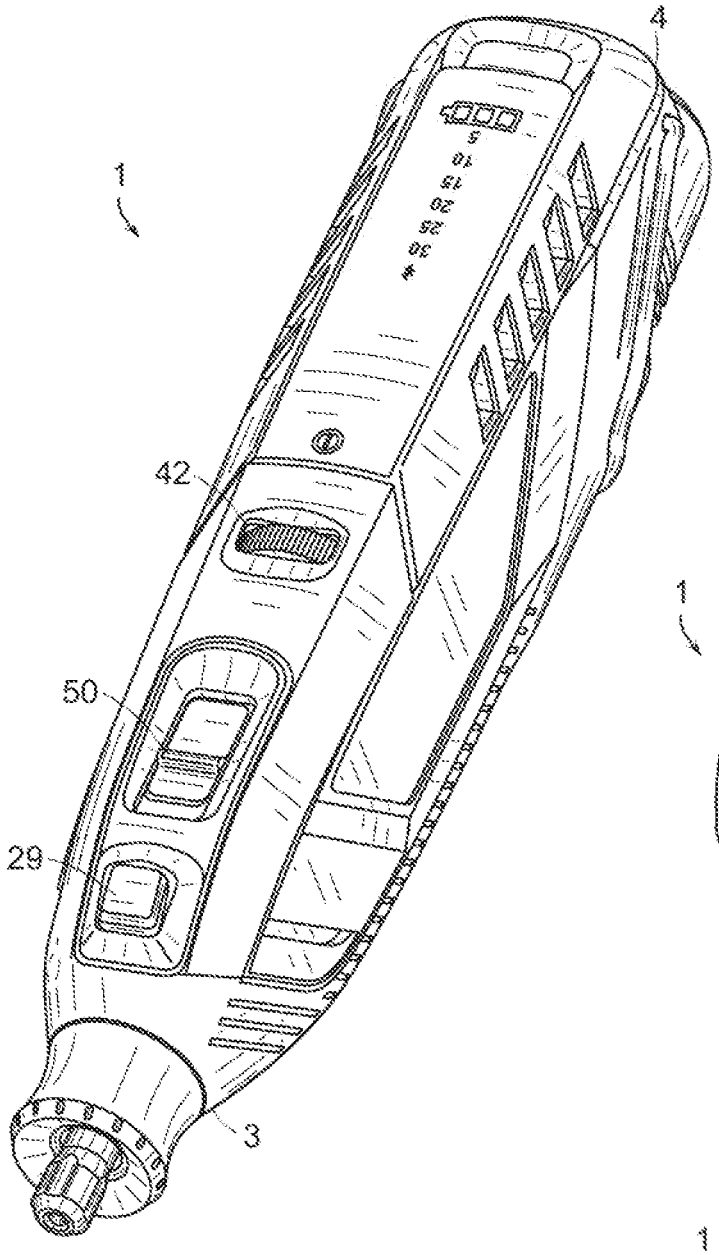
FIG. 14 is another perspective view of the hand-held rotary power tool of FIG. 1.
Figure 15:
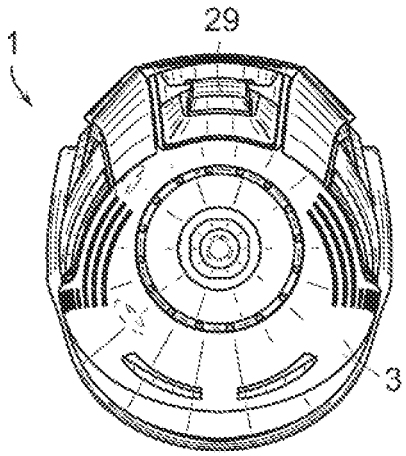
FIG. 15 is a front view of the hand-held rotary power tool of FIG. 1.
Figure 16:
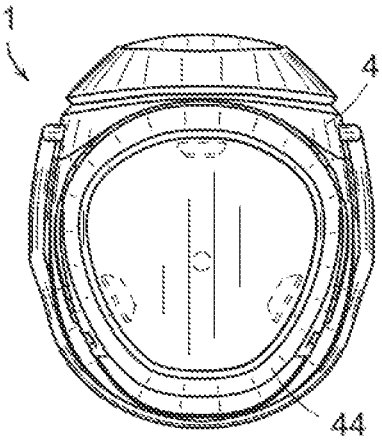
FIG. 16 is a rear view of the hand-held rotary power tool of FIG. 1.
Figure 17:
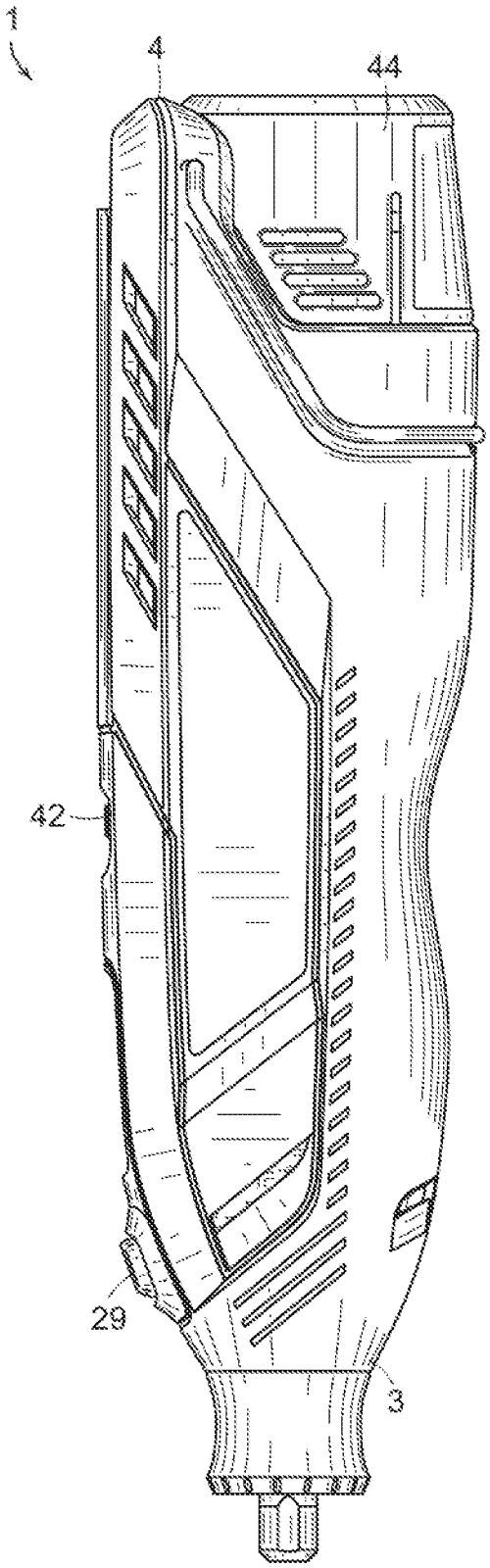
FIG. 17 is a left side view of the hand-held rotary power tool of FIG. 1.
Figure 18:
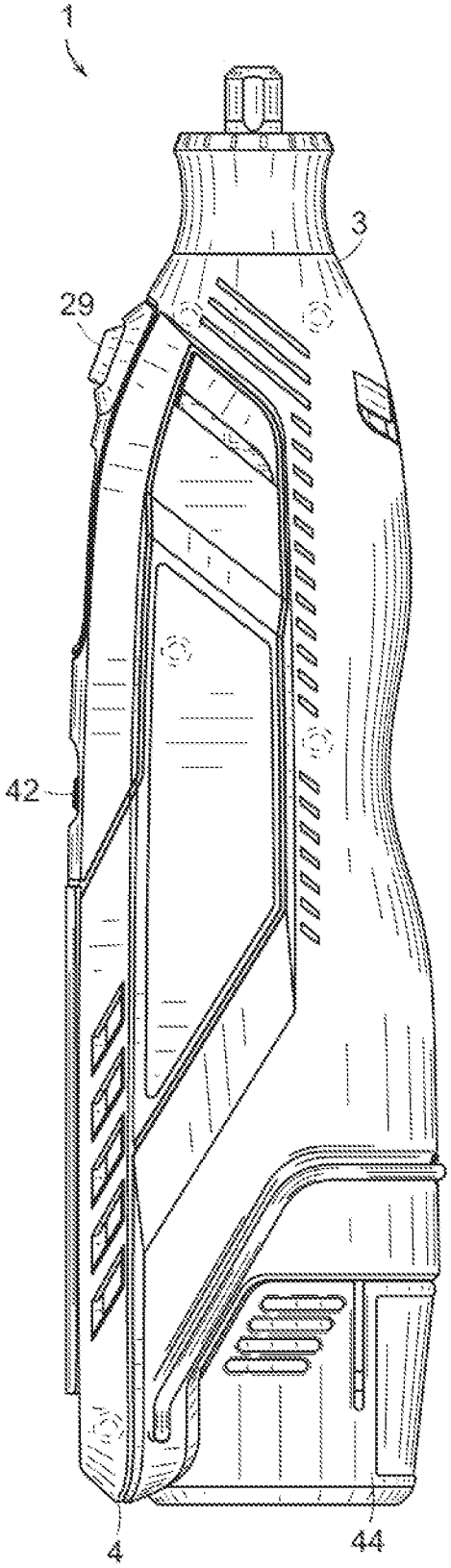
FIG. 18 is a right side view of the hand-held rotary power tool of FIG. 1.
Figure 19:
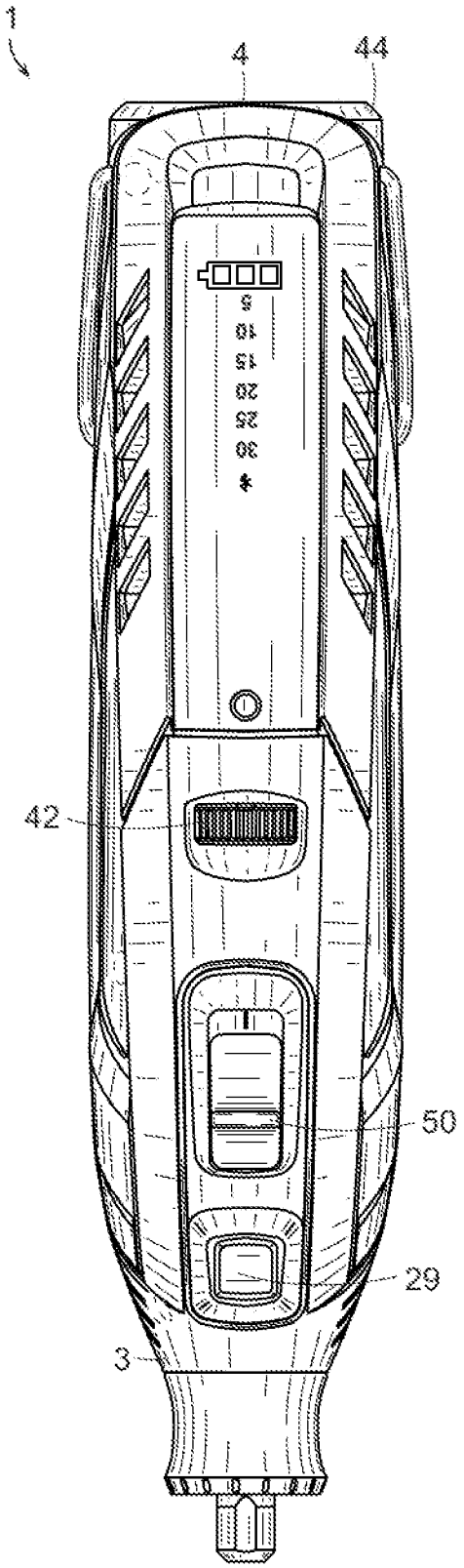
FIG. 19 is a top view of the hand-held rotary power tool of FIG. 1.
Figure 20:
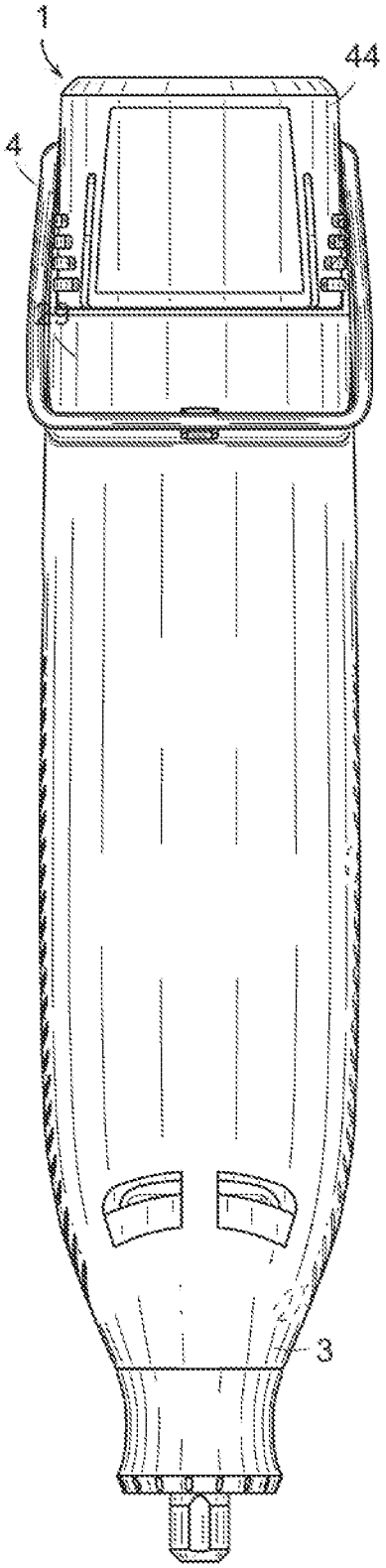
FIG. 20 is a bottom view of the hand-held rotary power tool of FIG. 1.

Referring to FIGS. 12-13, the guide plate 51 includes a locating tab 64 that protrudes outward from each of the first and second side portions 56(3), 56(4) of the peripheral edge 56. The locating tabs 64 are disposed at a location along the peripheral edge first and second side portions 56(3), 56(4) that is closer to the rear end portion 56(2) than the front end portion 56(1). The locating tabs 64 have a rounded profile when viewed from above, and each locating tab 64 is configured to engage with a corresponding pair of locating ribs 14, 15. To this end, a longitudinal dimension of each locating tab 64 is less than the spacing between the locating ribs 14, 15. In particular, when the switch actuator 50 is in the first actuator position, the locating tab 64 is disposed between the first rib 14 and the second rib 15 of the respective pair of locating ribs 14, 15, and when the switch actuator 50 is in the second actuator position, the locating tab 64 abuts a rearward-facing surface of the first rib 14 of the respective pair of locating ribs 14, 15.

The interaction between a locating tab 64 and the respective pair of locating ribs 14, 15 provides a detenting or clicking action so that the user can easily feel movement that is being made by the switch actuator 50 during operation. The interaction between a locating tab 64 and the respective pair of locating ribs 14, 15 also holds the switch actuator 50 in its desired location. The detenting action provides a sufficient level of resistance to initial movement that the likelihood that the switch actuator 50 will move without a conscious force being applied to it is small. If the switch actuator 50 is being used in a hand-held rotary power tool such as a Dremel™ tool, normal vibration experienced during operation of the power tool 1 should not affect the position of the switch actuator 50.

Referring again to FIGS. 8-11, the guide plate 51 includes a guiding tab 65 that protrudes outward from each of the peripheral edge first and second side portions 56(3), 56(4). The guiding tabs 64 are disposed at a location along the peripheral edge first and second side portions 56(3). 56(4) that is between the rear end portion 56(2) and a respective locating tab 64. The guiding tabs 65 have a greater longitudinal dimension than the locating tabs 64, and each guiding tab 65 has a generally rectangular profile when viewed from above.

In addition, the guide plate 51 includes a central opening 60 that is spaced apart from, and surrounded by, the peripheral edge 56. The central opening 60 is defined by an inner edge 61 that extends between the outward facing surface 54 and the inward facing surface 55. The central opening 60 has a width dimension (e.g., a dimension perpendicular to the longitudinal axis 21) that greater than a width dimension of the switch opening 16, and has a length dimension (e.g., a dimension parallel to the longitudinal axis 21) that is greater than a length dimension of the switch opening 16.

The resilient arm 66 protrudes from a connection portion 62 of the inner edge 61. The connection portion 62 is the portion of the inner edge 61 that is parallel to, and closest to, the rear end portion 56(2) of the guide plate peripheral edge 56.

Figure 10:
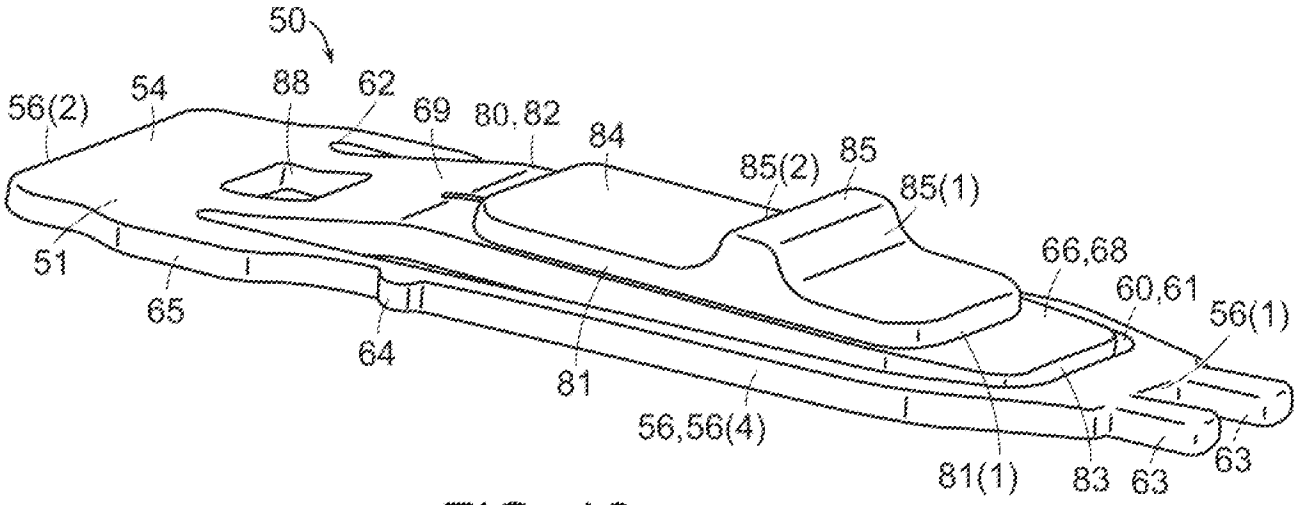
FIG. 10 is a perspective view of the switch actuator, shown in a configuration corresponding to the second actuator position.
Figure 11:
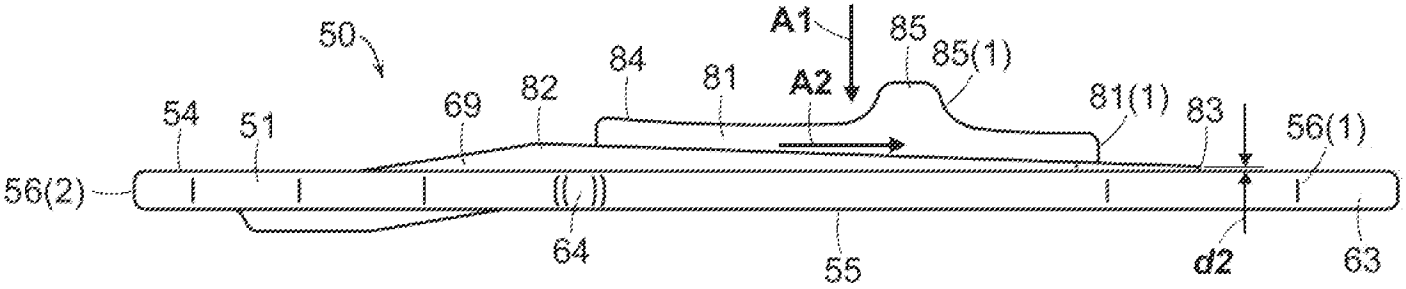
FIG. 11 is a side view of the switch actuator, shown in a configuration corresponding to the second actuator position.

The resilient arm 66 has a generally rectangular peripheral shape when the switch actuator 50 is viewed from above, and has dimensions that are slightly less than the corresponding dimensions of the central opening 60. As a result, the lever portion 68 of the resilient arm 66 can be moved into the guide plate central opening 60 upon application of an external force thereto (FIGS. 10-11). Upon release of an external force, the lever portion 68 elastically returns to the configuration in which it resides outside the central opening 60 and is offset from the guide plate 51 (FIGS. 8-9).

The resilient arm 66 includes a lever portion 68 and a ramp portion 69 that connects the lever portion 68 to the connection portion 62 of the inner edge 61. The lever portion 68 has a fixed end 82 that is contiguous with the ramp portion 69, and a free end 83 that is opposed to the fixed end 82 and faces the tool housing first end 3.

Figure 8:
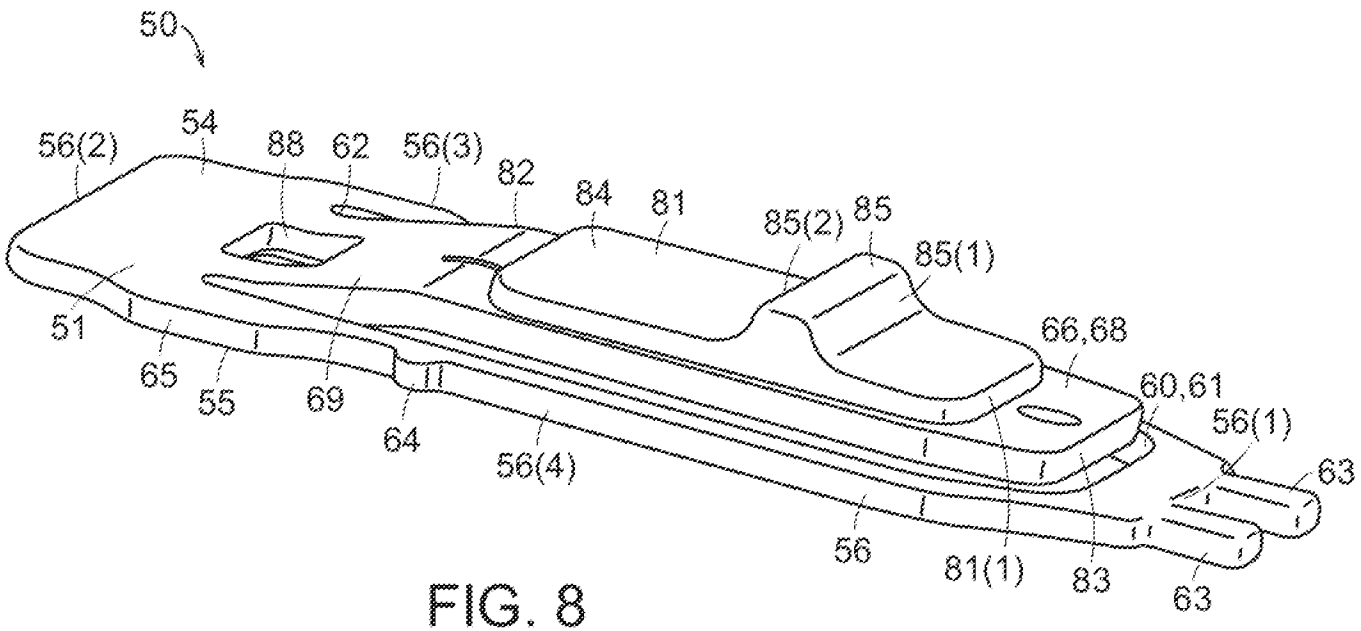
FIG. 8 is a perspective view of the switch actuator, shown in a configuration corresponding to the first actuator position.
Figure 9:
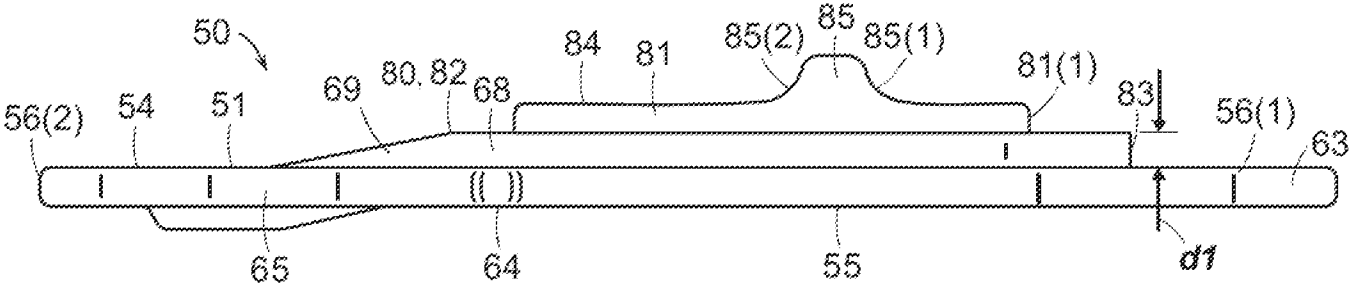
FIG. 9 is a side view of the switch actuator, shown in a configuration corresponding to the first actuator position.

The ramp portion 69 is angled relative to the outward-facing surface 54 of the guide plate 51 and the lever portion 68, whereby the lever portion 68 is offset relative to, and extends parallel to, the guide plate 51 when the switch actuator 50 is free of external loads (FIGS. 8 and 9). In particular, the lever portion 68 is closer to the switch opening 16 than the guide plate 51 when the switch actuator 50 is free of external loads.

The lever portion 68 of the resilient arm 66 includes a platform 81 that protrudes outward (e.g., toward the switch opening 16) from an outward-facing surface 80 of the lever portion 68. The platform 81 has a rectangular profile when the switch actuator 50 is viewed from above. The platform 81 has a width dimension (e.g., a dimension perpendicular to the longitudinal axis 21) that is slightly less than a width dimension of the switch opening 16. For example, the platform 81 may have a width dimension that provides a clearance fit with respect to the facing portions 18(3), 18(4) of the wall edge 18. The platform 81 has a length dimension that is less than a length dimension of the switch opening 16. For example, the length of the platform 81 is set so that a gap g exists between an end of the platform 81 and the switch opening 16, and a length of the gap g is at least a longitudinal travel distance of the switch actuator 50 when moving between the first actuator position and the second actuator position. When the switch actuator 50 is in the first actuator position, the gap g is disposed between a first end 81(1) of the platform and the first end portion 18(1) of the wall edge 18 (FIG. 6). In addition, when the switch actuator 50 is in the second switch actuator position, the gap g is disposed between a second end 81(2) of the platform and the second end portion 18(2) of the wall edge 18 (FIG. 7). By this configuration, the platform 81 resides in the switch opening 16 regardless of switch actuator position.

The outward-facing surface 84 of the platform 81 includes surface features that enhance gripping of the platform 81 by a fingertip of a user of the power tool 1. In the illustrated embodiment, the surface features include a finger ridge 85 that extends in a width direction of the platform 81. The finger ridge 85 is shaped and dimensioned to receive a fingertip so as to facilitate application of a longitudinal force by a user to the switch actuator 50. To this end, the finger ridge 85 has concavely rounded surfaces 85(1), 85(2) that extend between a terminal edge 86 of the ridge and the outward-facing surface 84 of the platform 81. More specifically, the finger ridge 85 has a first rounded surface 85(1) that faces the wall edge first end portion 18(1), and a second rounded surface 85(2) that faces the wall edge second end portion 18(2). The finger ridge 85 has a height dimension sufficient that a top edge of the finger ridge is flush with the tool housing outer surface 19 when the switch actuator is in the first actuator position. In addition to the finger ridge 85, the outward-facing surface 84 of the platform 81 may also include surface features that increase surface friction of the platform outward facing surface 84, such as a series of closely-spaced, shallow grooves or knurling (not shown).

The guide plate 51 includes a toggle opening 88 that is disposed along the connection portion 62 of the inner edge 61, whereby the toggle opening 88 extends into both the guide plate 51 and the ramp portion 69. The toggle opening 88 is shaped and dimensioned to receive a terminal end 41 of the contact element 40 in certain positions of the switch actuator 50. In the illustrated embodiment, the toggle opening 88 has a rectangular profile when viewed from above, but is not limited to this shape.

In the illustrated embodiment, the switch actuator 50 is a monolithic structure that is formed of plastic in an injection molding process.

The switch actuator 50 is used by the operator of the power tool 1 to control the on-off state of the power tool 1 by moving the switch actuator 50 relative to the tool housing 2 between the first actuator position (FIGS. 6, 8-9 and 12) and the second actuator position (FIGS. 7, 10-11 and 13). During this movement, the switch actuator 50 translates both longitudinally and radially. As used herein, the terms "longitudinally" and "radially" refer to movement directions that are made relative to the longitudinal axis 21. In particular, the term "longitudinally" refers to a movement that is parallel to the longitudinal axis 21, and the term "radially" refers to a movement that is perpendicular to the longitudinal axis 21.

Referring to FIGS. 6, 8-9 and 12, in the first actuator position, the switch actuator 50 is disposed in the tool housing as follows: The guide plate 51 rests on the shelf 8 such that the guide plate 51 is disposed radially inward relative to the inner surface 20 of the tool housing 2, and the rear end portion 56(2) of the guide plate 51 is positioned abutting the stop wall 9. In addition, the front end portion 56(1) of the guide plate 51 is disposed between the wall edge first end portion 18(1) and the control button opening 32, and guide rails 63 are longitudinally spaced apart from the shaft lock mechanism control button 29. The resilient arm 66 is offset radially relative to the guide plate 51 a first distance d1 (FIG. 9) so that the platform 81 protrudes into the switch opening 16. The free end 83 of the lever portion 68 of the resilient arm 66 is engaged with the wall edge recess 18(5) in such a way that the switch actuator 50 is prevented from longitudinal motion toward the tool housing first end 3. In other words, the switch actuator 50 is retained in the first actuator position the engagement between the lever portion free end 83 and the wall edge recess 18(5). In addition, the locating tabs 64 abut a rearward-facing surface of the first rib 14 of the respective pair of locating ribs 14, 15.

The switch actuator 50 cooperates with the contact element 40 in such a way that when the switch actuator 50 is in the first actuator position, the contact element 40 is in the first switch position. In particular, when the switch actuator 50 is in the first actuator position, the terminal end 41 of the contact element 40 extends into the toggle opening 88 (FIGS. 6 and 12), whereby the contact element 40 is at a first angle relative to the switch body 39 and the electrical switch 38 is positioned in the first switch position, e.g., an open position wherein electrical current does not flow between the power supply 44 and the electric motor 22.

Referring to FIGS. 7, 10-11 and 13, in the second actuator position, the switch actuator is displaced longitudinally toward the tool housing first end 3 relative to the first actuator position. The user moves the switch actuator 50 from the first actuator position to the second actuator position by placing a fingertip on the second rounded portion 85(2) of the lever portion 68 of the resilient arm 66 and applying a radially inward force that results in a first, radial movement (represented by arrow A1) followed by a longitudinally forward force that results in a second, longitudinal movement (represented by arrow A2) (FIG. 11). In the illustrated embodiment, the radial and longitudinal movements are perpendicular. As a result of the applied forces A1, A2, the lever portion 68 moves toward the guide plate 51, and is partially received in the central opening 60. In addition, the guide plate 51 is moved toward the tool housing first end 3.

More particularly, in the second actuator position, the switch actuator 50 is disposed in the tool housing as follows: The guide plate 51 rests on the shelf 8 such that the guide plate 51 is disposed radially inward relative to the inner surface 20 of the tool housing 2, and the rear end portion 56(2) of the guide plate 51 is longitudinally spaced apart from the stop wall 9. The front end portion 56(1) of the guide plate 51 is disposed between the wall edge first end portion 18(1) and the control button opening 32, and closer to the control button opening than when in the first actuator position. As a result, the guide plate guide rails 63 protrude into the shaft lock mechanism 28 in such a way that a guide rail 63 is disposed on each of opposed lateral sides of the control button 29, and a portion of the control button 29 is disposed between the guide rails 63. The resilient arm 66 is radially offset relative to the guide plate 51 a second distance d2 (FIG. 11). The second distance d2 is less than the first distance d1, whereby the free end 83 of the lever portion 68 is disengaged from the wall edge recess 18(5). In particular, lever portion free end 83 is disposed inward relative to the inner surface 20 of the tool housing 2, and is also disposed between the wall edge first end portion 18(1) and the control button opening 32. In addition, the locating tabs 64 are disposed between the first rib 14 and the second rib 15 of the respective pair of locating ribs 14, 15.

The switch actuator 50 cooperates with the contact element 40 in such a way that when the switch actuator 50 is in the second actuator position, the contact element 40 is in second switch position. In particular, when the switch actuator 50 is in the second actuator position, the terminal end 41 of the contact element 40 abuts the inward-facing surface 55 of the guide plate 51 at a location that is between the toggle opening 88 and the guide plate rear end portion 56(2), whereby the contact element 40 is at a second angle relative to the switch body 39, and the electrical switch 38 is positioned in the second switch position, e.g., a closed switch position in which electrical current does not flow between the power supply 44 and the electric motor 22.

Thus, the switch actuator 50 serves as a spring element, such that when the switch actuator 50 is in the first actuator position, the ramp portion 69 of the resilient arm 66 biases the lever portion 68 toward the wall edge 18 such that lever portion 68 engages the wall edge 18, thereby preventing inadvertent movement of the switch actuator 50 to the second actuator position. In addition, when the switch actuator 50 is actuated by applying a bi-directional force to the platform 81, the lever portion 68 is displaced from the wall edge 18, thereby permitting movement of the switch actuator 50 to the second actuator position.

The user moves the switch actuator 50 from the second actuator position to the first actuator position by placing a fingertip on the first rounded portion 85(1) of the lever portion 68 of the resilient arm 66 and applying a longitudinally rearward force (represented by arrow A3). As a result of the applied longitudinally rearward force A3, the guide plate 51 is moved longitudinally toward the tool housing second end 4. The longitudinal motion of the switch actuator 50 is limited by interaction between the guide plate rear end portion 56(2) and the stop wall 9, as well as interaction between the platform 81 and the second end portion 18(2) of the wall edge 18 that defines the switch opening 16. In addition, since the platform 81 is moved toward the tool housing second end 4, the lever portion free end 83 is aligned with the switch opening 16. In this position, the resilient properties of the switch actuator 50 return the lever portion 68 to its original radial offset position relative to the guide plate 51 in which the platform 81 protrudes into the switch opening 16 and the lever portion free end 83 is engaged with the wall edge recess 18(5).

Selective illustrative embodiments of the power tool including the switch actuator are described above in some detail. It should be understood that only structures considered necessary for clarifying the power tool including the switch actuator have been described herein. Other conventional structures, and those of ancillary and auxiliary components of the power tool and the switch actuator, are assumed to be known and understood by those skilled in the art. Moreover, while a working example of the power tool including the switch actuator has been described above, the power tool and the switch actuator are not limited to the working example described above, but various design alterations may be carried out without departing from the power tool as set forth in the claims.

We claim:

1. A power tool, comprising:

a tool housing including a wall portion, the wall portion including a switch opening that is defined by a wall edge that extends between an outer surface of the wall portion and an inner surface of the wall portion;

a motor disposed in the tool housing;

a power supply that is connected to the motor via an electrical circuit, the electrical circuit disposed in the tool housing; and an electrical switch disposed in the electrical circuit, the electrical switch including a switch body and a contact element that protrudes from the switch body, the contact element being movable relative to the switch body between a first switch position in which the electrical circuit is open and current is prevented from flowing from the power supply to the motor, and a second switch position in which the electrical circuit is closed and current flows from the power supply to the motor, a switch actuator that is disposed in the tool housing so as to be accessible to an operator of the power tool via the switch opening, the switch actuator including a guide plate that is disposed in the tool housing, and a resilient arm that extends from, and is integrally formed with, the guide plate, wherein the switch actuator is moveable relative to the tool housing between a first actuator position and a second actuator position, when the switch actuator is in the first actuator position, the guide plate is disposed A inward relative to the inner surface of the wall portion, a first edge portion of the guide plate is positioned at a first guide plate position relative to the tool housing, the resilient arm is offset relative to the guide plate a first distance so as to protrude into the switch opening, and a portion of an edge of the resilient arm is engaged with the wall edge, when the switch actuator is in the second actuator position, the guide plate is disposed inward relative to the inner surface of the wall portion, the first edge portion of the guide plate is positioned at a second guide plate position relative to the tool housing, the second guide plate position longitudinally spaced apart from the first guide plate position, the resilient arm is offset relative to the guide plate a second distance, and the second distance is less than the first distance whereby the portion of the edge of the resilient arm is disengaged from the wall edge and is disposed inward relative to the inner surface of the wall portion, and the switch actuator cooperates with the contact element in such a way that when the switch actuator is in the first actuator position, the contact element is in the first switch position, and when the switch actuator is in the second actuator position, the contact element is in second switch position.

2. The power tool of claim 1, wherein the switch actuator is actuated by applying a bi-directional manual force to the resilient arm.

3. The power tool of claim 1, wherein movement of the switch actuator between the first actuator position and the second actuator position requires a first movement in a first direction followed by a second movement in a second direction, and the second direction is perpendicular to the first direction.

4. The power tool of claim 1, wherein the guide plate comprises a central opening that is defined by an inner edge, and the resilient arm protrudes from the inner edge.

5. The power tool of claim 4, wherein the resilient arm includes a lever portion and a ramp portion that connects the lever portion to the inner edge, and the ramp portion is angled relative to an outward facing surface of the guide plate whereby the lever portion is offset relative to the guide plate.

6. The power tool of claim 1, wherein the switch actuator is a spring.

7. The power tool of claim 1, wherein the guide plate includes a toggle opening, when the switch actuator is in the first actuator position, a portion of the contact element extends into the toggle opening whereby the electrical switch is positioned in the first switch position, and when the switch actuator is in the second actuator position, the portion of the contact element abuts an inward facing surface of the guide plate, whereby the electrical switch is positioned in the second switch position.

8. The power tool of claim 1, wherein when the switch actuator is in the first actuator position, the resilient arm is biased toward the wall edge such that the portion of the edge of the resilient arm engages the wall edge, thereby preventing movement of the switch actuator to the second actuator position, and when the switch actuator is in the second actuator position, the portion of the edge of the resilient arm is displaced from the wall edge, thereby permitting movement of the switch actuator to the second actuator position.

9. The power tool of claim 1, wherein the tool housing includes a shelf that protrudes from the wall portion and at least partially underlies the switch opening, and the switch actuator is supported on, and is slideable relative to, the shelf.

10. The power tool of claim 9, wherein the shelf includes an opening, and the contact element protrudes through the opening.

11. The power tool of claim 1, wherein the tool housing includes a pair of locating ribs that protrude from the wall portion toward the switch actuator, the locating ribs extending in a direction that is perpendicular to a movement direction of the switch actuator, and the guide plate includes a second edge portion and a tab that protrudes from the second edge portion, when the switch actuator is in the first actuator position, the tab abuts a first rib of the pair of locating ribs, and the first rib of the pair of locating ribs is disposed between the tab and a second rib of the pair of locating ribs, when the switch actuator is in the second actuator position, the tab is disposed between the first rib of the pair of locating ribs and second rib of the pair of locating ribs.

12. The power tool of claim 1, wherein the resilient arm comprises an outward-facing surface, and a platform that protrudes from the outward-facing surface, the platform is shaped and dimensioned to be received within the switch opening regardless of switch actuator position, and the platform includes surface features that enhance gripping of the platform by a user of the power tool.

* * * * *